US005186221A

United States Patent [19]

Ellis

[11] Patent Number: 5,186,221

[45] Date of Patent: Feb. 16, 1993

[54] FUEL VAPOR FILTER

[76] Inventor: James E. Ellis, 1845 E. James, Mt. Vernon, Wash. 98273

[21] Appl. No.: 764,817

[22] Filed: Sep. 24, 1991

[51] Int. Cl.[5] ..... B67D 5/378

[52] U.S. Cl. ..... 141/59; 141/46; 141/285; 141/286; 141/301; 141/86.2; 141/746

[58] Field of Search ..... 141/46, 59, 98, 206, 141/285, 286, 301, 307, 392; 220/86.2, 746; 55/74, 387, 388

[56] References Cited

U.S. PATENT DOCUMENTS

| | | | |
|---|---|---|---|
| Re. 28,294 | 1/1975 | Hansel | 141/392 X |
| 2,214,708 | 9/1940 | Mayne et al. | 141/286 X |
| 2,910,098 | 10/1959 | Wood | 141/285 |
| 3,148,713 | 9/1964 | Jones, Jr. | 141/286 X |
| 3,291,165 | 12/1966 | Fraylick | 141/286 |
| 3,748,829 | 7/1973 | Joyce et al. | 55/74 |
| 3,907,010 | 9/1975 | Burtis et al. | 141/59 X |
| 3,911,973 | 10/1975 | Casteline, Jr. | 141/59 |
| 3,918,932 | 11/1975 | Lee et al. | 55/62 |
| 3,921,412 | 11/1975 | Heath et al. | 62/54 |
| 3,946,771 | 3/1976 | Braun et al. | 141/59 |
| 3,994,322 | 11/1976 | Overall | 141/46 |
| 3,996,977 | 12/1976 | Hansel | 141/285 |
| 4,062,384 | 12/1977 | Frahm et al. | 141/46 |
| 4,100,758 | 7/1978 | Mayer | 62/54 |
| 4,630,749 | 12/1986 | Armstrong et al. . | |
| 4,701,198 | 10/1987 | Uranishi et al. | 55/387 |
| 4,762,156 | 8/1988 | Rich | 141/46 |
| 4,809,864 | 3/1989 | Neuthard et al. . | |
| 4,825,914 | 5/1989 | Leininger | 141/59 |
| 4,966,299 | 10/1990 | Teets et al. . | |
| 4,977,936 | 12/1990 | Thompson et al. | 141/312 |

FOREIGN PATENT DOCUMENTS

| | | | |
|---|---|---|---|
| 3007223 | 9/1981 | Fed. Rep. of Germany | 141/206 |
| 0625970 | 8/1978 | U.S.S.R. | 141/285 |

*Primary Examiner*—Henry J. Recla
*Assistant Examiner*—Casey Jacyna
*Attorney, Agent, or Firm*—Trask, Britt & Rossa

[57] ABSTRACT

A fuel vapor filter (10) for use with a fuel nozzle (22) for filtering fuel-entrained vapor (60) displaced from a fuel tank and a fuel tank fill tube (18) during refueling. The filter (10) comprises a housing (12) containing a filter (14). An external boot (16) encloses the fill tube (18) during refueling. A splash shield (46) prevents splashing of liquid fuel on the filter housing (12). The filter (10) of the present invention protects people and the environment by preventing the escape of fuel-entrained vapor from the fuel tank during refueling.

8 Claims, 1 Drawing Sheet

FUEL VAPOR FILTER

TECHNICAL FIELD

The present invention is directed to a fuel vapor filter, and, more particularly, to a portable filter designed for removable engagement over a fuel delivery nozzle and subsequent sealable engagement with a fuel tank fill tube during refueling such that displaced gas must pass through the filter to remove entrained fuel vapor and fumes prior to venting to the atmosphere.

BACKGROUND OF THE INVENTION

Liquid fuel tanks typically have a fill tube attached thereto that extends to a fill port at the open end of the fill tube. Fuel is placed in the tank through a nozzle that is inserted into the open end of the fill tube at the fill port. Because most motor vehicle fuel tanks do not have a separate vent line, gas and vapor displaced by incoming fuel is forced upstream through the fill tube past the incoming liquid fuel and thence through the open end of the fill tube to the atmosphere. As a consequence, the displaced gas becomes entrained with fuel vapor, resulting in liquid and noxious fumes being forced into the atmosphere.

A drawback to this arrangement is that a person handling the fuel delivery nozzle and standing in close relationship to the fuel tank fill tube is exposed to the fuel-entrained gas displaced from the open end of the fill tube. More particularly, the person is forced to breath the noxious fumes during the refueling process. In addition, fuel inadvertently ejected from the fill tube during refueling can splash on the person's hands and clothes. This leaves an unpleasant odor and stains that are difficult to remove. Not only is this unpleasant, but it is hazardous to nearby people and objects, and it is damaging to the environment.

While there are devices that are designed to prevent the splashing of fuel, these devices do not filter the displaced filter. For instance, one device consists of a flexible skirt permanently affixed to the nozzle on the end of a fuel pump hose. This skirt does not sealably engage the fill tube when the nozzle is placed into the fill tube. Rather, this skirt is positioned adjacent the fill tube such that liquid splashing out of the fill tube is redirected into and around the fill tube. It does not prevent the escape of liquid and fuel vapor from the fill tube itself and contamination of the environment. This skirt is not used on a majority of fuel pump nozzles and cannot be easily detached and moved to another nozzle. Consequently, there is a need for a portable fuel vapor filter that efficiently and easily seals the nozzle when the nozzle is placed in the fill tube, prevents the escape of liquid fuel, and filters fuel-entrained vapor prior to venting of the vapor to the atmosphere.

SUMMARY OF THE INVENTION

The present invention is directed to a portable fuel vapor filter for sealable engagement to the open end of a fuel tank fill tube during refueling to prevent the fuel-entrained vapor and liquid fuel forced from the fill tube by displaced gas from the fuel tank. The filter comprises a housing having an interior and an exterior. A central opening is formed in the housing that is sized and shaped to receive a fuel delivery nozzle in slidable engagement. One or more vents or openings are formed in the housing such that there is fluid communication between the interior and the exterior of the housing. A filter is mounted inside the housing such that vapor and liquid fuel displaced out of the fill tube by fuel from the delivery nozzle passes through the filter before venting to the atmosphere to prevent the escape of liquid and fuel vapor to the atmosphere, thus protecting the person handling the nozzle from exposure to harmful fuel vapors.

In accordance with another aspect of the present invention, the housing further includes a seal mounted in the central opening that is sized to sealably engage the fuel delivery nozzle.

In accordance with another aspect of the present invention, a splash shield is formed around the perimeter on the interior side of the central opening that is sized and shaped to prevent splashing of fuel from the open end of the fill tube.

In accordance with yet another aspect of the present invention, the housing includes a compressible boot formed on one end of the housing for slidable engagement over the open end of the fill tube to prevent the escape of liquid fuel and vapor from the fuel tank fill tube.

As will be readily appreciated from the foregoing description, the present invention provides a unique portable tube filter for fuel tank fill tubes that reduces the escape of noxious vapors during refueling. The filter is formed of sizes that make it useful with any size fill tube and any size fuel delivery nozzle. Because it is portable, the filter can be stored in a vehicle where it will always be available for use. In addition, the filter can be placed over the fuel delivery nozzle and remain in place when the nozzle is not in use. In addition to being lightweight and portable, this filter is easily manufactured with few parts at low cost. As a result, use of the filter formed in accordance with the present invention is an inexpensive and simple method for protecting human health and the environment.

DETAILED DESCRIPTION OF THE PREFERRED EMBODIMENT

Figure 1:
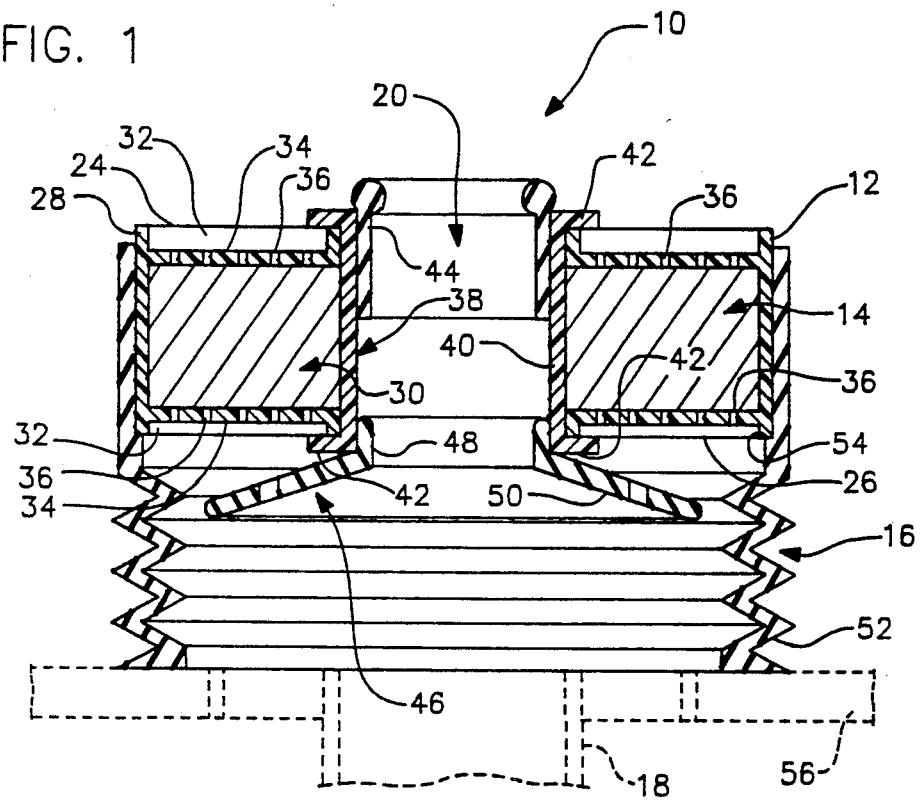
FIG. 1 is a side view in cross section of the fuel vapor filter formed in accordance with the present invention.
Figure 2:
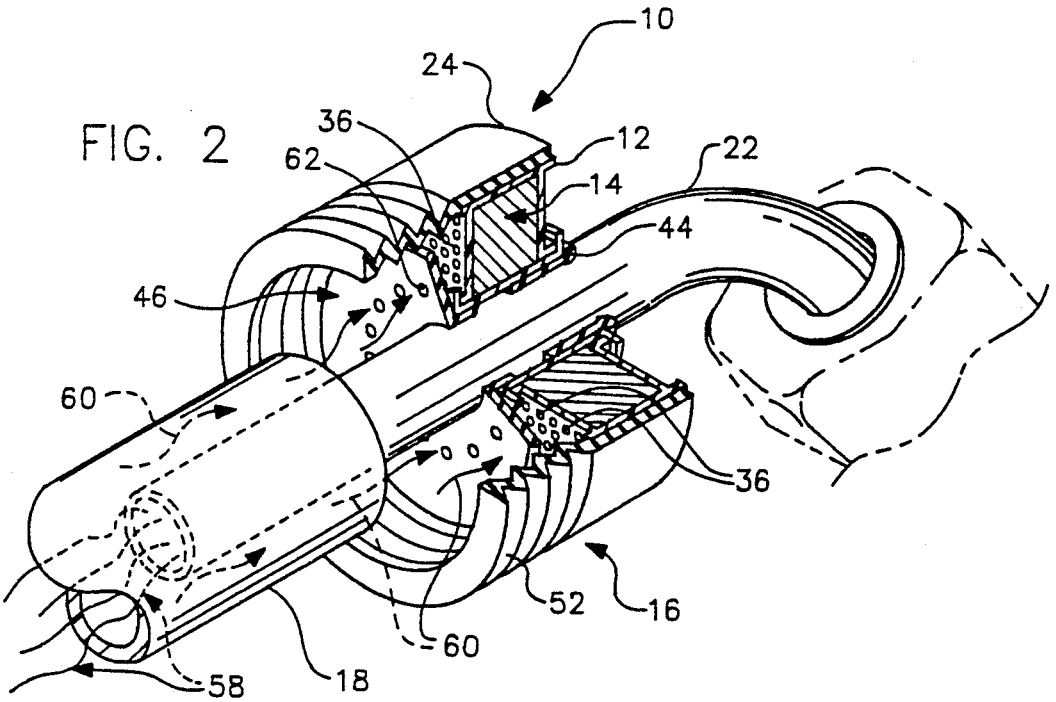
FIG. 2 is an isometric view in partial cross section of the filter of FIG. 1 mounted on a nozzle and sealably engaged with a fuel tank fill tube.

Referring initially to FIG. 1, the filter 10 of the present invention is illustrated having generally a housing 12, a filter 14 contained within the housing 12, a boot 16 for sealably engaging the housing 12 with a fill tube 18, and a central opening 20 formed in the housing 12 for receiving a fuel delivery nozzle 22 (shown in FIG. 2).

The body 12 is generally cylindrical in shape and is formed of a top 24, bottom 26, and sidewall 28. The top 24 and bottom 26 each have upstanding circumferential flanges 32. Formed orthogonal to the flanges 32 are planar retaining walls 34 in the top 24 and bottom 26 with a plurality of openings 36 formed therethrough. The top 24, bottom 26, and sidewall 28 define an enclosed interior 30 in which the filter 14 is held in place by the retaining walls 34. The openings 36 in the retaining walls 34 provide fluid communication between the exterior of the housing 12 and the interior 30.

A central tube 38 provides the fourth wall for the housing 12. The tube 38 is positioned in the central opening 20 and is comprised of a vertical cylindrical wall 40 having an upper and lower horizontal flange 42 projecting outward therefrom. The horizontal flanges 42 engage the upright flanges 32 on the top 24 and bottom 26. Convenient methods may be used for attaching the central tube 38 to the top 24 and bottom 26 such as friction, bonding agent, etc. Ideally, the housing 12 can be disassembled to enable replacement of the filter 14.

A seal 44 is attached near one end of the tube 38 and is sized and shaped to slidably engage a fuel delivery nozzle 22 to prevent the escape of gas and fluid. Similarly, a flexible splash shield 46 is formed at the other end of the tube 38. This splash shield 46 consists of a circular base 48 having a circular flange 50 extending outward therefrom and depending partially downward. The circular flange 50 extends approximately three-quarters of the way towards the outside circumference of the housing 12 to provide a sizable surface against which the fuel can splash against during refueling.

To provide additional sealing, a boot 16 is attached tot he exterior of the housing 12 and depends downward therefrom to a skirt portion 52. The skirt portion 52 is accordion-shaped in cross section such that the boot 16 is collapsible when pressed against a more rigid surface. The skirt 52 has an inside diameter sized to be received over the neck of a fill tube without interference. Ideally, the top 62 of the boot 16 is engaged with the outside of the housing 12 and includes a shoulder 54 that bears against the bottom 26 to prevent movement of the housing 12 in the boot 16.

The filter 10 can be constructed of lightweight plastic and polymer materials to make it easily portable and storable. If desirable, the filter 10 can be constructed as a throw-away unit or may be formed to allow replacement of the internal filter 14. For example, the housing 12 and central tube 38 may be constructed of plastic, while the seal 44, splash shield 46, and boot 16 can be constructed of flexible polymer.

FIG. 2 illustrates the filter 10 of the present invention in use on a fuel delivery nozzle 22. A fill tube 18 is shown in association with a vehicle 56 (shown in phantom in FIG. 1). The filter 10 is placed on the fuel delivery nozzle 22 by inserting the nozzle 22 through the central opening 20. The nozzle 22 is then placed in the fill tube 18 and pushed inward until the boot 16 bears against the body 56 on the outside of the circumference of the fill tube 18 in sealable engagement. The seal 44 on the top of the tube 38 seals the filter 10 against the fuel delivery nozzle 22. As fuel 58 is pumped into the fill tube 18 through the fuel delivery nozzle 22, vapor 60 is forced out of the fill tube 18 and through the vent openings in the body 56 adjacent the fill tube 18. The vapor 60 is passed through the filter 14 by means of openings 36 in the retaining wall 34. Fuel-entrained vapor is trapped in the filter 14 and the filtered air exits the filter 10 through the openings 36 in the retaining wall 34 in the top 24. Liquid fuel splashing up in the fill tube 18 is deflected by the splash shield 46.

When refueling, the nozzle 22 is removed from the fill tube 18. The filter 10 can then be removed from the nozzle 22 and stored in the vehicle for future use. Optionally, the filter 10 can remain engaged with the nozzle 22.

While a preferred embodiment of the invention has been illustrated and described, it is to be understood that various changes may be made therein without departing from the spirit and scope of the invention. Consequently, the invention is to be limited only by the scope of the claims that follow.

The embodiments of the invention in which an exclusive property or privilege is claimed are defined as follows:

1. A portable filter to enable sealable mating of a fuel delivery nozzle with a fuel tank fill tube during refueling to prevent the passing of fuel vapors to the atmosphere, the filter comprising:
   - a housing having a central opening sized to be slidably engaged with a fuel delivery nozzle;
   - one or more vents formed in said housing to enable fluid communication between an interior of said housing and the exterior of said housing;
   - means for sealably engaging said housing with the open end of a fuel tank fill tube;
   - a filter means positioned in said housing such that as fuel is delivered to the fuel tank, displaced gas exiting through the fill tube passes through said filter means to remove entrained fuel vapor prior to venting to the atmosphere; and
   - means for deflecting liquid away from said filter means, said deflecting means being positioned between said filter means and said engaging means to deflect liquid fuel splashing out of the fuel tank fill tube back into the fuel tank fill tube wherein said deflecting means comprises a flange having a first end connected to said central opening and a second unconnected end projecting from said central opening to a position adjacent said engaging means.

2. The filter of claim 1, wherein said sealable engagement means comprises a compressible boot attached to one end of said housing.

3. The filter of claim 2, wherein said compressible boot is sized and shaped to be slidably engaged over the exterior of the open end of the fuel tank fill tube.

4. The filter of claim 2, wherein said housing further includes means for sealing the fuel delivery nozzle in said central opening in said housing to prevent the escape of fluid and gas and, furthermore, whereby said housing can be quickly engaged and disengaged with the fuel delivery nozzle.

5. The filter of claim 2, wherein said filter means is removably mounted within said housing to enable replacement of said filter means.

6. The filter of claim 1, wherein said flange is formed in a conical shape and is positioned to angle away from said filter means to thereby deflect liquid into the fill tube.

7. The filter of claim 6, wherein said engaging means comprises a compressible boot attached to one end of said housing, and further wherein said compressible boot is sized and shaped to be slidably engaged over the exterior of the open end of the fuel tank fill tube.

8. The filter of claim 7, wherein said filter is removably mounted within said housing to enable replacement of said filter means.

* * * * *